United States Patent [19]

Kutscher et al.

[11] Patent Number: 4,612,044

[45] Date of Patent: Sep. 16, 1986

[54] METHOD OF VACUUM TREATING METAL MELTS, AND VESSEL FOR USE IN THE METHOD

[75] Inventors: Horst Kutscher; Gernot Zahs, both of Dortmund, Fed. Rep. of Germany

[73] Assignee: VACMETAL Gesellschaft für Vakuum-Metallurgie mbH, Dortmund, Fed. Rep. of Germany

[21] Appl. No.: 761,653

[22] Filed: Jul. 30, 1985

Related U.S. Application Data

[63] Continuation of Ser. No. 656,167, Sep. 28, 1984, abandoned.

[30] Foreign Application Priority Data

Sep. 30, 1983 [DE] Fed. Rep. of Germany ..... 3335476

[51] Int. Cl.[4] ..... C21C 7/10

[52] U.S. Cl. ..... 75/49; 75/59.28; 75/59.29; 266/207

[58] Field of Search ..... 75/49, 59.28, 59.29, 75/59.3; 266/207, 208

[56] References Cited

U.S. PATENT DOCUMENTS

| | | | |
|---|---|---|---|
| 3,592,456 | 7/1971 | Miklos | 75/49 |
| 3,689,046 | 9/1972 | De Bie | 75/49 |
| 3,779,743 | 12/1973 | Olsson | 75/49 |
| 3,867,136 | 2/1975 | Eriksson | 75/59.28 |
| 4,071,356 | 1/1978 | Yamamoto | 75/49 |
| 4,208,206 | 6/1980 | Death | 75/59.28 |

FOREIGN PATENT DOCUMENTS

| | | | |
|---|---|---|---|
| 1248556 | 10/1971 | United Kingdom | 75/49 |
| 1569158 | 6/1980 | United Kingdom | 75/49 |

*Primary Examiner*—Peter D. Rosenberg

*Attorney, Agent, or Firm*—Toren, McGeady, Stanger, Goldberg & Kiel

[57] ABSTRACT

In a method of vacuum treating metal melts, especially steel melts, a vacuum syphon vessel (1) is used with its suction pipe (2) dipping into the melt (4) in a ladle (3) so that a portion of the melt is drawn into the vessel (1) and is varied between levels (A) and (B), and oxygen surrounded by a protective medium is blown horizontally into the melt in the vessel (1) below the surface of the melt through one or more nozzles (6) immediately above the bottom (5) of the vessel (1) and/or in the upper part of the suction pipe (2).

17 Claims, 6 Drawing Figures

METHOD OF VACUUM TREATING METAL MELTS, AND VESSEL FOR USE IN THE METHOD

This is a continuation of application Ser. No. 656,167, filed Sept. 28, 1984, and now abandoned.

This invention relates to a method of vacuum treating metal melts, especially steel melts, in a vacuum vessel dipping into a ladle containing the melt, in which oxygen surrounded by a protective medium is blown into the melt which is drawn into the vacuum vessel, and also relates to a vacuum vessel for use in the method.

Methods of this type using a very wide variety of vacuum vessels are well known, particularly for the vacuum decarburization of chrome-containing steel melts, since the chrome slagging is low, even at the usual refining temperatures, on account of the displacement of the equilibrium curve of the carbon/oxygen reaction towards lower carbon contents which takes place with decreasing pressure.

For example VAKUUM-TECHNIK (VACUUM TECHNIQUE), 1976, pages 17 to 20, describes a vacuum cycling method for the refining of chrome steel melts in the manner of the oxygen blowing-out process, wherein the oxygen is blown by means of a water-cooled lance onto the surface of a circulating steel melt having a carbon content of from 0.2 to 0.6%. The rate of decarburization depends upon the oxygen flow rate per unit time and the circulating rate of the steel. The tip of the lance must, however, be situated just above the melt, in order not to endanger the refractory lining of the vacuum vessel and to avoid sucking of the oxygen out of the vacuum vessel. The short distance of the lance from the melt leads to a correspondingly small focal area and a low decarburization rate corresponding to the boundary area between the oxygen and the melt, since the focal area is surrounded by slag, which impedes a rapid reaction of the gaseous oxygen with the melt. Furthermore, as the oxygen jet strikes the melt surface, spattering of steel and slag occurs, with the consequent risk of clogging of the lance opening.

German specification No. OS 1 904 442 describes a method which avoids the above disadvantages by means of a lance which can travel in the vacuum vessel and through which oxygen is blown at supersonic speed onto the melt surface. The supersonic speed of the oxygen jet and the relatively large distance of the lance from the melt surface lead to sharp focussing of the jet and avoidance of the risk of steel and slag spatter reaching the oxygen lance and of oxygen being sucked out by the vacuum pump before it has reacted with the melt. Here again, however, with a high oxygen content of the melt, the oxygen utilization is low on account of the relatively small boundary area between the oxygen and the melt. Furthermore, the refractory lining of the vacuum vessel is subjected to heavy wear by the oxygen and also by the steel and slag spatter.

The disadvantages associated with the top blowing of oxygen can be avoided if the refining oxygen is blown into the melt through a porous plug disposed in the bottom of the vacuum vessel, as in the process described in German Utility Model specification No. 191 26 68. Porous plugs of this type are, however, subjected to extremely heavy wear, on account of the violent reaction of the oxygen with the melt and the resultant high temperatures at the exit surface of the plug.

German Patent specification No. 2 654 048 describes another method of vacuum refining, using a circulating degassing vessel with a horizontal nozzle composed of two concentric pipes, through the inner pipe of which oxygen is blown into the melt while a protective medium is supplied through the annular space between the inner and outer pipes. Since the chrome slagging, according to the explanations in this Patent specification, depends essentially upon the distance of the entry point of the refining oxygen from the surface of the melt in the vessel, the nozzles are located 20 to 50 cm below the melt surface, for a pressure over the melt of 200 torr. Accordingly, in this method the melt surface is always at least 20 cm above the oxygen entry point, which is certainly possible in a circulating degassing vessel. Furthermore, the oxygen is to be blown into the melt in the direction of flow of the circulating melt. However, although these conditions can be assured in a circulating process, they cannot in the case of a vacuum syphon process since there is little or no melt in the vacuum vessel in the top dead-centre position and the melt does not possess any consistent direction of flow.

The present invention is based upon the surprising finding that the length of a gas jet entering a melt at sonic speed is dependent solely upon the density of the melt, and not upon the ferrostatic pressure above the nozzle outlet. The length of an oxygen jet blown into a metal melt in a vacuum vessel is thus inversely proportional to the cube root of the density of the metal melt. This enables optimum dimensions to be given to the vacuum vessel, having regard to the most complete loading possible of the melt quantity located in the vacuum vessel, and also means that a vacuum syphon method of vacuum treating metal melts may be carried out in which oxygen or an oxygen-containing gas is blown into the melt below its surface.

According to the invention therefore, there is provided a method of vacuum treating a metal melt, especially a steel melt, contained in a ladle using a vacuum syphon vessel having a suction pipe dipping into the ladle melt so that a portion of the melt is drawn into the vacuum vessel, in which oxygen surrounded by a protective medium is blown substantially horizontally into the melt in the vacuum vessel directly above the bottom of the vessel and/or in the upper part of the suction pipe.

As experiments have shown, this leads to residence times of 1 to $2\times10^{-3}$ seconds, in spite of the continually changing depth of the melt above the oxygen entry point, whereas skilled persons have hitherto assumed that the gas bubbles ascend vertically immediately after leaving the nozzle.

Since the length of the jet can be predicted from the density, the diameter of the vacuum vessel can be so chosen that virtually the entire cross-section is affected by the oxygen jet, regardless of whether the oxygen is blown into the melt from one or more different positions around the vessel. In this manner, in spite of the continually changing quantity and depth of the melt in the vacuum vessel, constant refining conditions and therefore a reliable analysis, are obtained. This applies in particular to the case when the vacuum vessel is stopped for a certain period in its lower, and possibly also in its upper dead-centre position.

According to another aspect of the invention, a vacuum syphon vessel for use in carrying out the method has a suction pipe at its bottom, and at least one nozzle comprising a pair of concentric pipes directed substantially horizontally into the vessel immediately above the bottom and/or in the upper part of the suction pipe. The vessel bottom may be inclined at from 5° to 20° to the horizontal towards the centrally situated suction pipe, in view of the jet angle in the melt of 20°.

Examples of the method and apparatus in accordance with the invention will now be described with reference to the accompanying drawings, in which.

Figure 1:
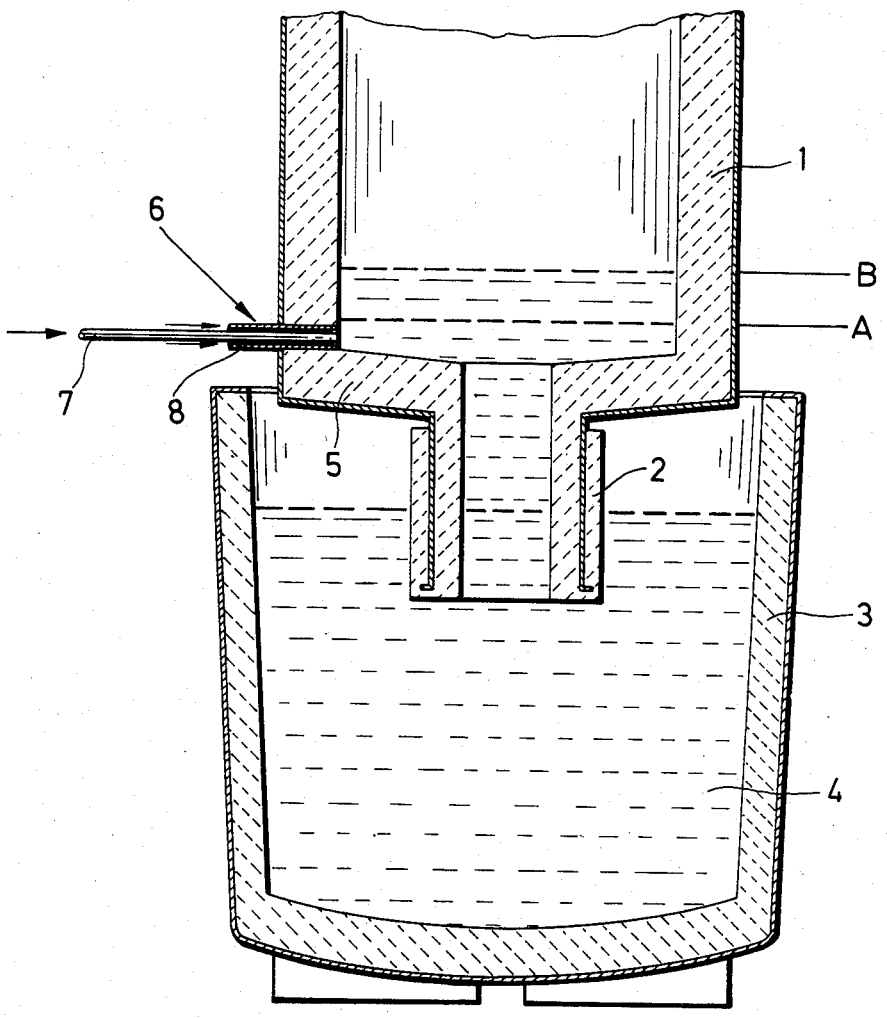
FIG. 1 is a vertical section through part of a first example of a vacuum syphon vessel in conjunction with a ladle.

In FIG. 1 a vacuum syphon vessel 1 is shown with its suction pipe 2 dipping into a melt 4 situated in a ladle 3. In the lateral wall of the vacuum vessel 1, immediately above the vessel bottom 5, an oxygen nozzle 6 consisting of an inner pipe 7 for the oxygen and an outer pipe 8 for inert gas concentrically surrounding the inner pipe, is situated for blowing oxygen surrounded by inert gas horizontally into the vessel 1.

Figure 2:
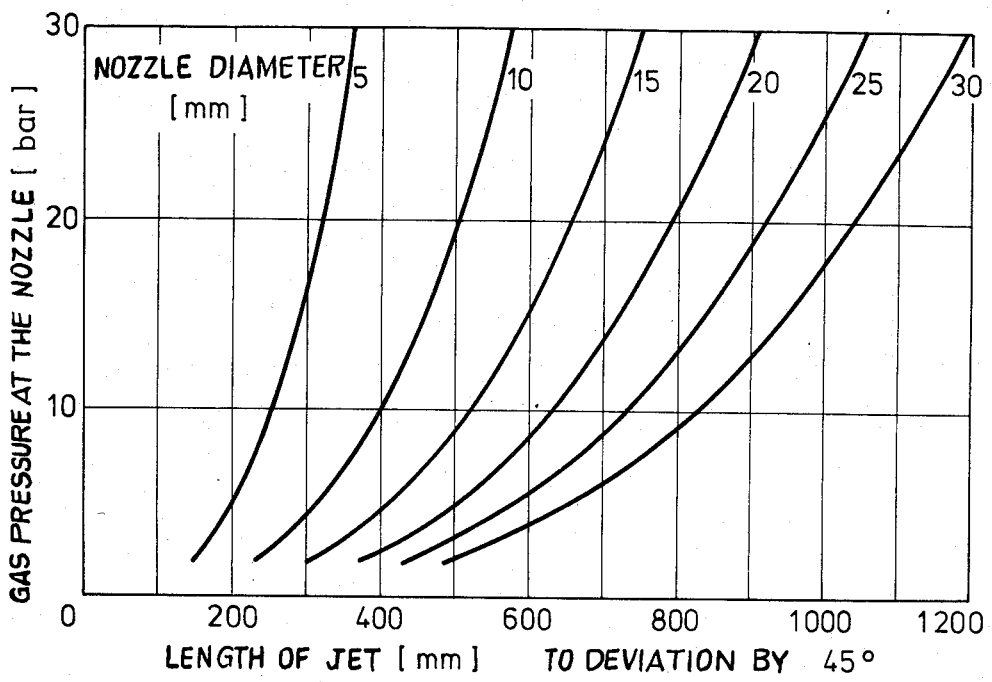
FIG. 2 is a graph showing the oxygen jet length as a function of gas pressure in the supply line upstream of the nozzle and the nozzle diameter during the blowing of oxygen into a melt in the vacuum vessel.

During vacuum degassing with the vessel 1 the depth of the melt in the vacuum vessel 1 varies from A (top dead-centre) to B (bottom dead-centre), so that the entry point of the nozzle 6 is always situated below the melt surface. In spite of the periodically changing melt depth between A and B, the oxygen can be blown into the melt at a constant rate with time in view of the constant jet length, without the refining conditions thereby changing. This can be seen from FIG. 2, in which the set of curves show that the jet length for small nozzle diameters is only slightly dependent upon the gas pressure upstream of the nozzle. For larger nozzle diameters, the dependence of the jet length upon the gas pressure upstream of the nozzle, in contrast, increases. Accordingly, it is recommended that the oxygen necessary for refining is blown into the melt through a plurality of nozzles of small diameter.

Figure 3:
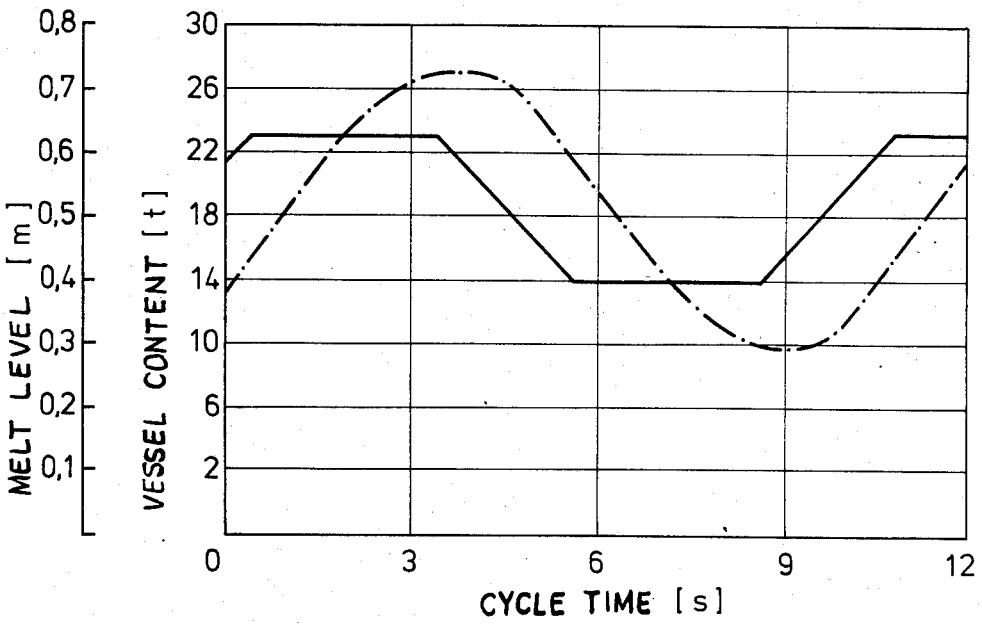
FIG. 3 is a graph showing the change with time of the melt depth and quantity of steel in the vacuum vessel in an example of the method.

In FIG. 3, the full line shows for a 300 tonnes melt the calculated value of the portion sucked into the vacuum vessel for an initial height of 400 mm (A in FIG. 1) and a stroke of 700 mm, during a cycle under static conditions and without delay, the amount changing in inverse proportion to the stroke travel of the vacuum vessel. The quantity actually situated in the vacuum vessel is, however, shown by the dot-and-dash curve, and not only is this quantity greater than the quantity corresponding to static equilibrium, but due to liquid friction and dynamics it follows the stroke movement of the vacuum vessel with a time delay. This opens up the possibility, by using a holding time in the top and bottom dead-centre positions of the vacuum vessel, of influencing the inflowing and outflowing of steel in respect of quantity. Experiments have shown in this connection that the holding time in the top dead-centre position should be from approximately 2 to 4 seconds.

Figure 4:
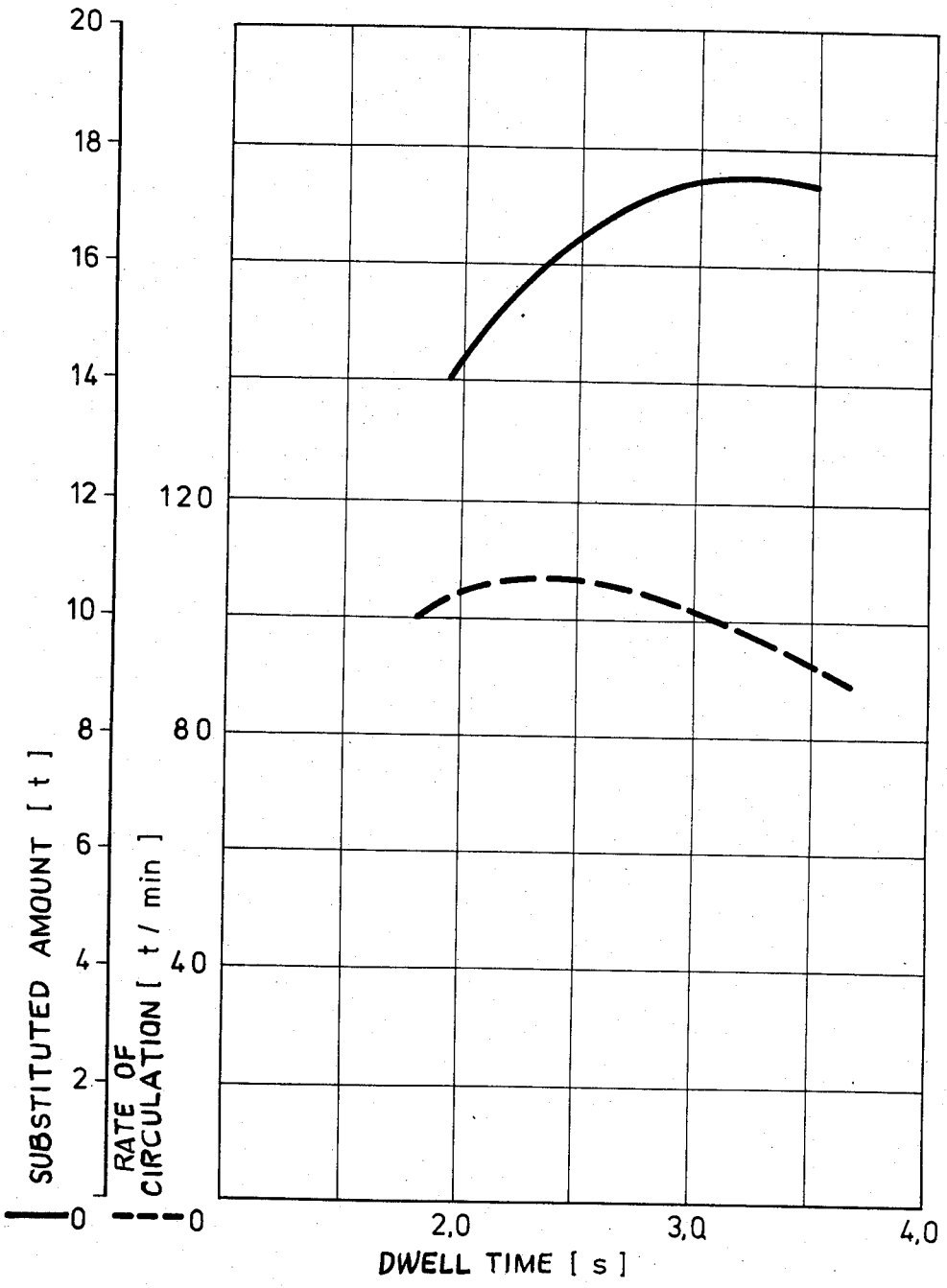
FIG. 4 is a graph showing the exchange quantity and circulation rate as a function of the stopping time in the bottom dead-centre position of the vacuum vessel in an example of the method.

The holding time at the bottom dead centre position may, in contrast, be from 2 to 6 seconds, preferably from 15 to 45 seconds, since in this manner a maximum possible exchange quantity per vessel stroke can be obtained as shown from the curves of FIG. 4. The curve shown in broken line relates here to tests with a 300 tonne ladle, a vacuum vessel stroke of 700 mm, and an initial height A above the suction pipe/vessel bottom of 400 mm. In these conditions the minimum melt quantity in the vacuum vessel is at least 10 tonnes.

Figure 5:
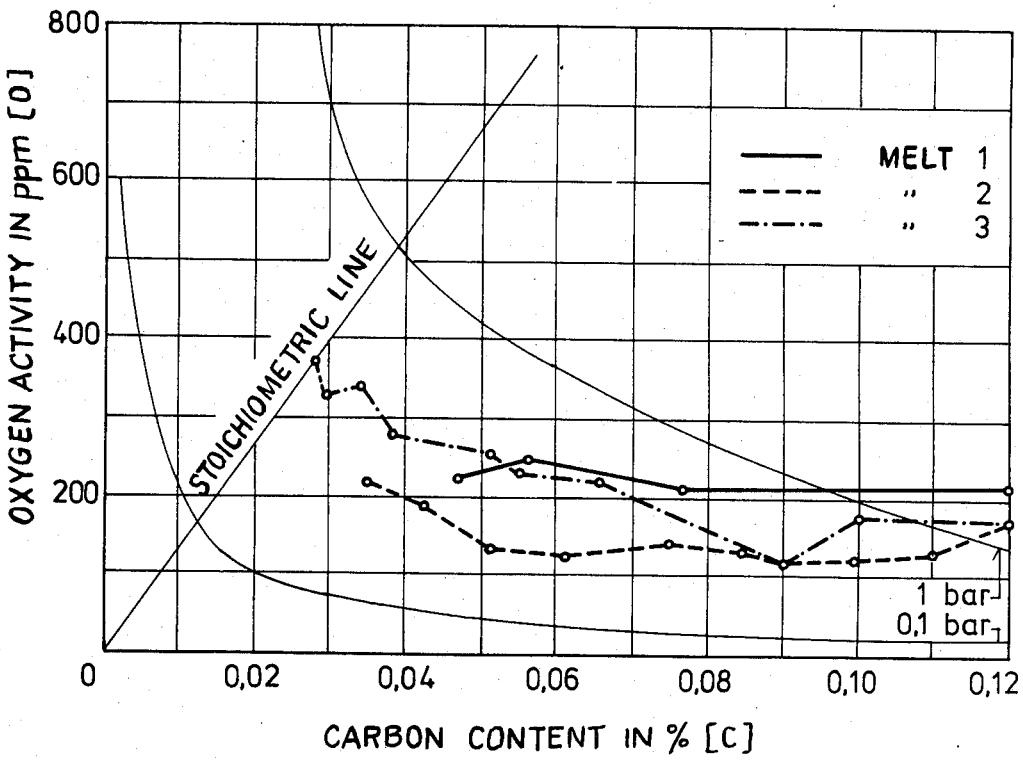
FIG. 5 is a graph showing the relationship between the carbon and oxygen contents for three test melts; and, FIG. 6 is a view similar to that of FIG. 1 but showing a different example of the vacuum vessel.

Since, in view of the high oxygen potential of the steel leaving the vacuum vessel, a violent carbon oxidation can under certain circumstances occur in the ladle melt 4, the carbon content of the melt portion situated in the vacuum vessel should be reduced to only about 10 to 50% in the case of a pressure of from 20 to 250 mb. In an example of the method in accordance with the invention using the vacuum syphon vessel of FIG. 1 and an oxygen quantity of 1500 $Nm^3/h$, the decarburization pattern shown in FIG. 5 is obtained for three melts, the holding time in the upper dead-centre position being 3 seconds and in the lower dead-centre position 18 seconds. Also, the oxygen feed was interrupted and scavenging then carried out only with argon after a carbon content of 0.02 to 0.04 had been reached. In this manner final carbon contents of 10 ppm can reliably be achieved.

The method in accordance with the invention can, however, also be carried out in such a way that the surface of the melt in the vacuum vessel 1 in its upper dead-centre position lies below the level of the nozzle 6. In this case the blowing-in of the oxygen is intermittent, the oxygen being blown into the melt in the vacuum vessel only so long as the melt surface is situated above the nozzle level. If the melt surface sinks below, then both the internal pipe 7 and the annular outer pipe 8 of the nozzle 6 are supplied with a protective medium, preferably an inert gas. The quantity of inert gas supplied is then so regulated that a sufficient protection of the nozzle and of the refractory material surrounding the nozzle is assured. In this method of proceeding, the holding time in the upper dead-centre position is preferably 2 to 3 seconds and in the lower dead-centre position preferably 15 to 45 seconds.

Figure 6:
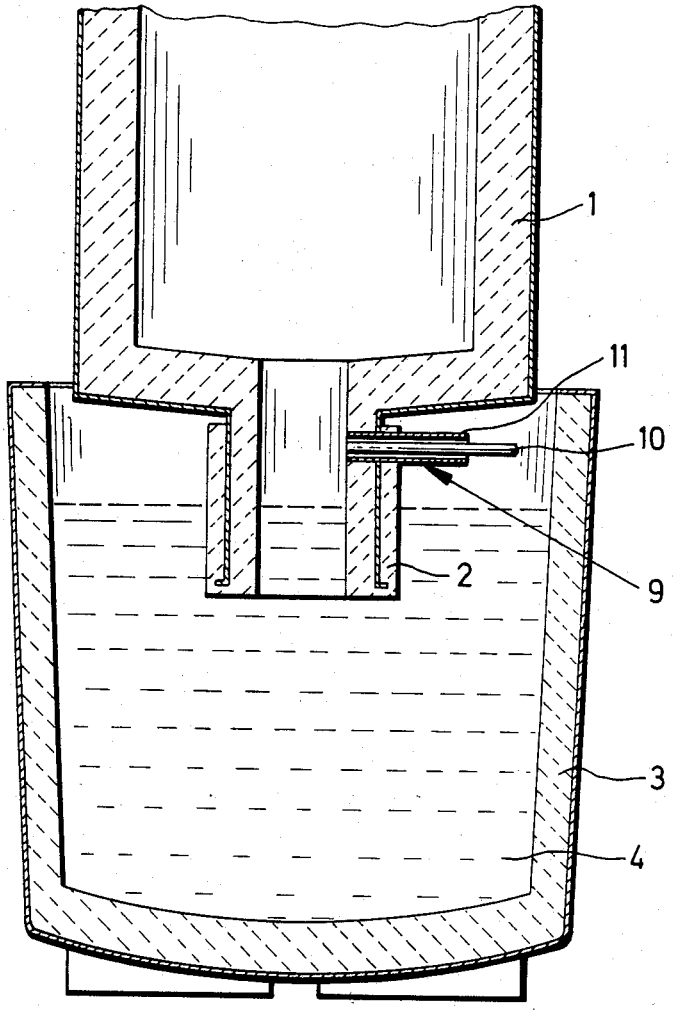

The method in accordance with the invention can also be carried out with a vacuum syphon vessel 1 as shown in FIG. 6, in which a nozzle 9 consisting of two concentric pipes 10 and 11 is disposed horizontally in the upper part of the suction pipe 2. This construction has proved particularly favourable when the oxygen is blown in at least partly with the objective of burning exothermally oxidisable substances, especially aluminium, for the purpose of heating the melt. In this case it has proved advantageous, for controlling the combustion reaction and also in respect of the life of the nozzle and of the refractory material surrounding the nozzle, to dilute the oxygen blown in through the inner pipe 10 in a ratio of 1:5 to 20 with an inert gas. As soon as sufficient oxygen has been supplied to the melt, both the inner pipe 10 and outer pipe 11 are supplied with inert gas, in order to prevent the penetration of the melt into the nozzle 9.

We claim:

1. A method of vacuum treating a metal melt, including a steel melt, contained in a ladle, comprising the steps of providing a vacuum syphon vessel having a bottom and a suction pipe extending therefrom, operating said vacuum syphon vessel with a reduced pressure in said vessel and with said suction pipe dipping into said laddle melt whereby a portion of said melt is drawn into said vacuum syphon vessel for treatment, and blowing oxygen surrounded by a protective medium substantially horizontally into said melt portion in said vacuum vessel directly above said bottom of said vessel.

2. A method as claimed in claim 1, wherein said oxygen surrounded by said protective medium is also blown into said melt portion in said vacuum vessel in the upper part of said suction pipe.

3. A method as claimed in claim 1, wherein operation of said vacuum vessel includes cycling said vessel between top and bottom dead-centre positions to change said melt portion in said vessel, and each cycle includes stopping said vacuum vessel in said bottom dead-centre position for 2 to 60 seconds.

4. A method as claimed in claim 3, wherein said vacuum vessel is stopped in each cycle for 15 to 45 seconds in said bottom dead-centre position.

5. A method as claimed in claim 3, wherein each cycle includes stopping said vacuum vessel for 2 to 4 seconds in said upper dead-centre position.

6. A method as claimed in claim 3, wherein said melt portion in said vacuum vessel is decarburized in each cycle to 1 to 50% of the carbon content of said melt in said ladle.

7. A method as claimed in claim 1, wherein said reduced pressure in said vacuum vessel is 20 to 250 mb.

8. A method as claimed in claim 1, wherein said oxygen is blown into said melt intermittently.

9. A method as claimed in claim 3, wherein said oxygen is blown into said melt intermittently and said method includes blowing only inert gas into said melt during the concluding phase of the upward movement of said vacuum vessel in each cycle.

10. A method as claimed in claim 2, wherein said oxygen blown into said melt in said upper part of said suction pipe is mixed with an inert gas.

11. A method as claimed in claim 1, including a concluding phase of scavenging at reduced pressure exclusively with argon.

12. A method of vacuum treating a metal melt, including a steel melt, contained in a ladle, comprising the steps of providing a vacuum syphon vessel having a bottom and a suction pipe extending therefrom, operating said vacuum syphon vessel with a reduced pressure in said vessel and with said suction pipe dipping into said ladle melt whereby a portion of said melt is drawn into said vacuum syphon vessel for treatment, and blowing oxygen surrounded by a protective medium substantially horizontally into said melt portion in said vacuum vessel in the upper part of said suction pipe of said vacuum vessel.

13. A method as claimed in claim 12, wherein said oxygen blown into said melt is mixed with an inert gas.

14. A vacuum syphon vessel for use in a method of vacuum treating a metal melt, including a steel melt, contained in a ladle, said vacuum vessel including a bottom, a suction pipe extending from said bottom for dipping into said melt in said ladle, and at least one nozzle directed substantially horizontally into said vessel immediately above said bottom thereof, said nozzle comprising a pair of concentric pipes whereby oxygen surrounded by a protective medium can be blown into said vessel through said nozzle.

15. A vacuum vessel as claimed in claim 14, including at least one nozzle directed substantially horizontally into said suction pipe in the upper part thereof, said nozzle comprising a pair of concentric pipes whereby oxygen surrounded by a protective medium can be blown into said vessel through said nozzle.

16. A vacuum vessel as claimed in claim 14, wherein said bottom of said vacuum vessel is inclined to the horizontal at from 5° to 20°.

17. A vacuum syphon vessel for use in a method of vacuum treating a metal melt, including a steel melt, contained in a ladle, said vessel including a bottom, a suction pipe extending from said bottom for dipping into said melt in said ladle, and at least one nozzle directed substantially horizontally into said suction pipe in the upper part thereof, said nozzle comprising a pair of concentric pipes whereby oxygen surrounded by a protective medium can be blown into said vessel through said nozzle.

* * * * *